US005531059A

United States Patent [19]

Dickinson

[11] Patent Number: 5,531,059

[45] Date of Patent: Jul. 2, 1996

[54] METHOD FOR SHRINK WRAPPING LUGGAGE

[76] Inventor: Donald L. Dickinson, #9 Bishop's Crest Ct., St. Peters, Mo. 63376

[21] Appl. No.: 315,964

[22] Filed: Sep. 30, 1994

[51] Int. Cl.[6] ..... B65B 61/14

[52] U.S. Cl. ..... 53/413; 53/397; 53/442

[58] Field of Search ..... 53/442, 413, 459, 53/397, 557, 567, 134.1, 469, 594; 206/497, 432, 597; 190/26

[56] References Cited

U.S. PATENT DOCUMENTS

| | | | |
|---|---|---|---|
| 3,508,375 | 4/1970 | Myers . | |
| 3,662,514 | 5/1972 | Goss | 53/459 |
| 3,808,767 | 5/1974 | Reid | 53/557 |
| 3,815,313 | 6/1974 | Heisler . | |
| 3,818,182 | 6/1974 | Linde . | |
| 3,820,205 | 6/1974 | Shaw | 53/557 |
| 3,901,360 | 8/1975 | Cook | 190/26 |
| 3,990,576 | 11/1976 | Heaney . | |
| 4,555,025 | 11/1985 | Weinberg et al. . | |
| 4,765,123 | 8/1988 | Caldwell | 53/459 |
| 5,172,795 | 12/1992 | Riceman | 190/26 |
| 5,293,975 | 3/1994 | Howorka | 190/26 |
| 5,299,406 | 4/1994 | Laury . | |
| 5,329,747 | 7/1994 | Williams, Jr. | 53/442 |

FOREIGN PATENT DOCUMENTS

| | | | |
|---|---|---|---|
| 489537 | 1/1953 | Canada | 190/26 |
| 0029419 | 5/1981 | European Pat. Off. | 53/557 |

*Primary Examiner*—John Sipos
*Assistant Examiner*—John Paradiso
*Attorney, Agent, or Firm*—Robbins & Robbins

[57] ABSTRACT

A method is provided for wrapping a plastic bag about a piece of luggage to leave the handle grip exposed. A heat shrinkable plastic bag is used with the luggage being loosely enclosed and the edge of an open top of the bag being folded over the top surface of the luggage around the sides of the grip to leave the grip exposed. The bag may be dispensed from a roll and may be in the form of a flat bag having an open top or in the form of a flat tube having an open top and bottom. A hot air gun is employed to seal the folded over edges and the loosely enclosing bag to a tight seal around the luggage. A pressure sensitive tape may be employed to tack together the folded over edges. Measurements are taken along the length, width and height of the luggage to provide a formula for the size of the plastic bag to be employed. The shrink wrapped luggage is used to prevent theft and provide visual signs of breaking into and also to provide protection against marring or scuffing.

6 Claims, 2 Drawing Sheets

METHOD FOR SHRINK WRAPPING LUGGAGE

BACKGROUND OF THE INVENTION

In the past, the protection of various pieces of luggage, such as suitcases, valises, briefcases and the like while in transit, has presented a problem. This problem while present wherever luggage is transported, has been particularly prevalent in airports where many pieces of luggage are transferred and handled by many different personnel at various airports nationally and internationally, making it difficult to determine where damage or theft has occurred.

While locks may be provided as a deterrent to theft and pilfering, they can be easily broken and removed with no evidence to draw attention to the point where the incident occurred. The same problem exists with physical damage to the surface of the luggage where marring of the surface such as by cuts and scratches can be difficult to pinpoint as to the area of occurrence.

Encapsulating of luggage with a heat shrinkable plastic wrap has been proposed in U.S. Pat. No. 5,299,406. In this patent a method and machine have been described using a system of rolls of plastic sheets and carriers for the luggage which is automatically wrapped with sheeting which is welded together to wrap the luggage while leaving the handle grip free for carrying.

While the method and machine shown in this patent may be effective for the purpose described, the machine is complex, extensive and does not lend itself to varied operations and baggage handling operations where the installation of the machine is not practical because of the size, expense and other reasons.

There has remained a problem to provide a method for wrapping luggage with heat shrink plastic to leave the grip free which can be employed on a practical scale at a modest cost and with efficiency.

SUMMARY OF THE INVENTION

By means of this invention there has been provided a method for shrink wrapping plastic bags or the like around luggage to completely enclose it while leaving the handle grip clear for baggage handling and transfer.

The method may be utilized by the user or desirably at airport terminals, railroad or bus stations to enclose in a simple and inexpensive manner the luggage for protection against pilfering or physical damage to the surface of the luggage such as scratches and marring by physical contact with baggage handling equipment.

The method employs selecting a heat shrinkable bag of a predetermined size according to the length, width and height of the luggage in order that the bag may be loosely fitted around the luggage with the open top of the bag being fitted around the grip so as to expose it. The bag may be in the form of a flat bag having an open top or a flat tube having an open top and bottom which may be formed into a bag. The bags may be supplied on rollers in a conventional perforated tear-apart mode in order that the bag may be simply separated. Different sized bags may be provided on a bank of rollers to provide proper selection.

Once the bag has been fitted around the luggage, a heat gun is employed to form the bag around the grip and the rest of the luggage surface and corners to shrink and tightly encapsulate the plastic bag around the luggage. The edges may be tacked together by a pressure sensitive adhesive tape. Once sealed, the luggage is protected against abrasion and is a deterrent to pilferage since the cutting or tearing of the bag to gain access to the luggage is immediately apparent.

The simplicity of the method lends itself to widespread use when luggage is checked into the airport terminal or other luggage handling system. Since only the shrink bags and a simple heat gun are employed, the method may be practiced with ease and a minimum cost in investment and may be safely and expeditiously carried out without the requirement of long training and special skills.

The heat shrink bags may be in various forms such as two sided panels or the like, four upright panels with a bottom similar to a supermarket kraft paper bag or a tubular bag cut to size by a user and sealed at the bottom in the heat shrinking method.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
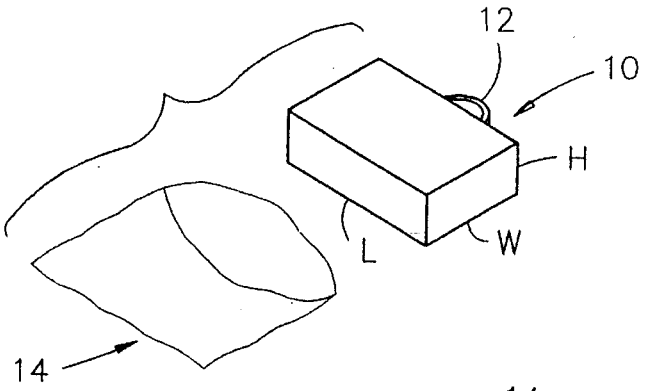
FIG. 1 is a pictorial view of a piece of luggage and the plastic bag used.

In FIG. 1, a conventional piece of luggage is shown as a suitcase 10 with a handle grip 12. It has a length L, width W and height H which are measured in inches with the measurements being employed to determine the size of the bag to be used.

Figure 4:
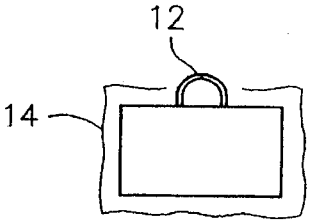
FIG. 4 is a view in elevation of a first stage of enclosing the luggage.
Figure 5:
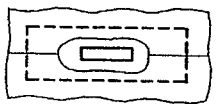
FIG. 5 is a top plan view of a second stage showing the bag enclosing the luggage.

A plastic bag 14 is also shown in FIG. 1 and has been pre-selected to have the proper size to fit loosely over the luggage 10 as shown in FIG. 4. It is constructed of conventional shrink wrappable plastic which upon application of heat from an electric heat gun 16, such as shown in FIG. 5, will cause the plastic bag to shrink. The thickness desirably may be about 4 mils to withstand the wear and tear encountered in baggage handling. This thickness may also vary down to about 1 mil to about 6 mils depending upon whether light duty or heavy duty is to be encountered.

Figure 2:
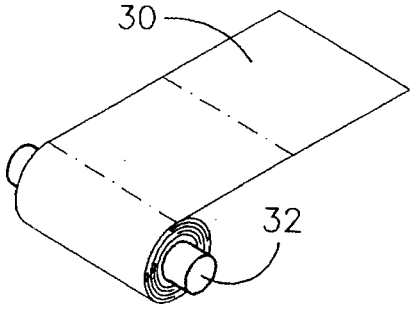
FIG. 2 is a pictorial view of a roll of plastic bags.
Figure 3:
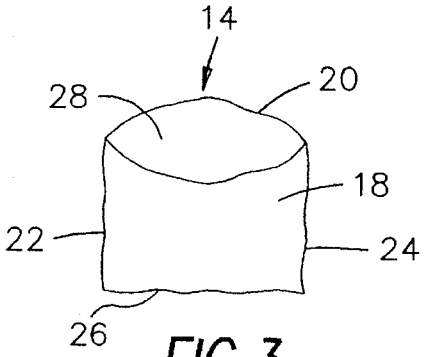
FIG. 3 is a pictorial view of a plastic bag opened for use.

The plastic bag 14 is further shown in FIG. 3. It may be in the form of front and back panels 18 and 20 joined at the sides 22 and 24 and bottom 26 and having an open top 28. The panels may be joined by seaming or thermoplastic weld or can be made integral as desired. The bags are shown in tear-off web form 30 supported on a roller 32 in FIG. 2. It will be understood that different sizes of bags may be supported on a rack of rollers for easy dispensing.

In selecting the optimum bag size, the user first measures the length L, the width W, and the height H, shown for the luggage 10 in FIG. 1, in inches. By adding one inch to the height and then adding this number to the length and this number to the width, the size of the heat shrinkable plastic material bag a person would need to cover their luggage is determined.

EXAMPLE 1

If the luggage measures 25×20×6 inches, one inch is added to the height=7 inches.

Add this seven inches to the length=32 inches

Add this seven inches to the width=27 inches

This provides a bag that measures 32×27×7 inches

The above example provides an optimum size but it will be understood that the bag may be slightly smaller or somewhat larger to provide a tolerance that may be employed.

Figure 6:
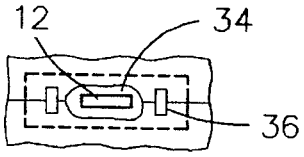
FIG. 6 is a view similar to FIG. 5 showing a later stage of closing the top edges of the bag about the handle.
Figure 7:
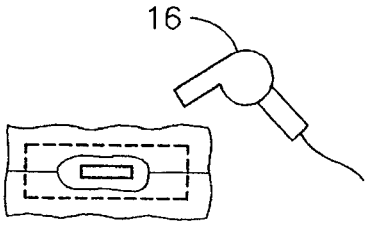
FIG. 7 is a view of a final stage showing the heat shrinking of the bag with a hot air gun.
Figure 8:
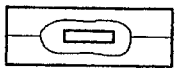
FIG. 8 is a view similar to FIG. 7 showing the finished bag encapsulated luggage.

After the bag has been selected, it is fitted over the luggage in the positions shown in FIGS. 1 and 4. With the open top of the bag enclosing the top of the luggage and grip 12 as shown in FIG. 4 the top edges of the bag are folded over one another while leaving an opening 34 as shown in FIG. 5. The top edges are taped together by tapes 36 to hold them together as shown in FIG. 6 as heat from the heat gun 16 shown in FIG. 7 is applied. This tape may desirably be in the form of a pressure sensitive thermosetting plastic tape such as the Scotch Super Bond Tape provided by 3M Company. As heat is directed from the heat gun, the bag 14 shrinks to form a tight protective seal around the luggage as shown in FIG. 8.

The shrink wrapped bag sealed around the luggage provides a tight protective enclosure. The exposed grip 12 may be used without interference by the sealed shrink wrap. The fitting and heat shrinking operations are simple and can be carried out efficiently and rapidly by the user whether a traveler or at a baggage handling station.

Figure 9:
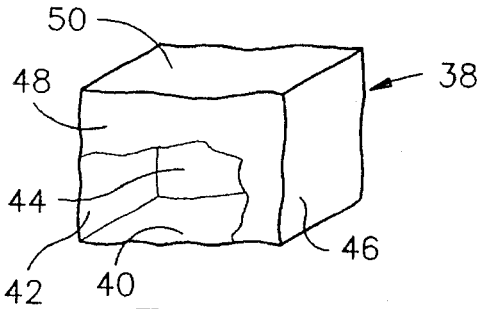
FIG. 9 is a pictorial view partly broken away of an open box-like heat shrinkable plastic bag which may be optionally employed.

While the invention has been described with respect to a two panel bag 14 as shown in FIG. 3, other forms of bags may also be employed. One such bag is shown at 38 in FIG. 9 where an open bag similar in shape to the open top kraft paper bags employed at grocery stores may be used. Such a bag has a flat bottom 40, four upright panels 42, 44, 46 and 48 and an open top 50. It may be fitted and heat sealed in the manner previously described using the heat gun 16.

Figure 10:
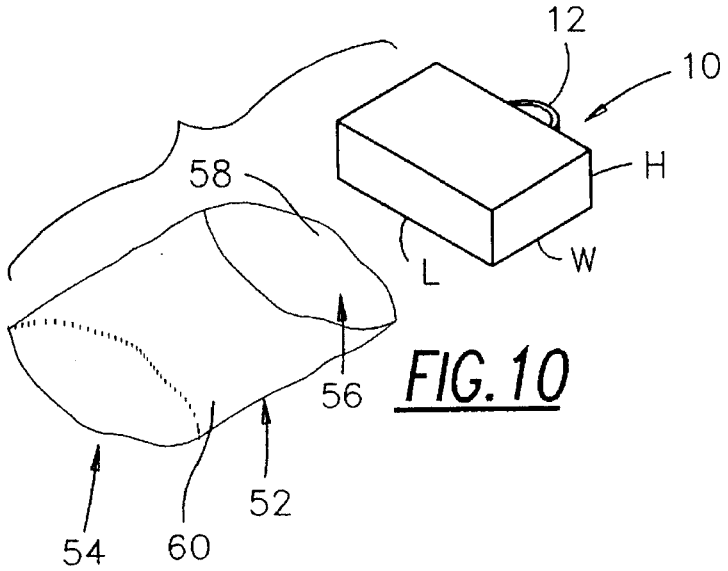
FIG. 10 is a pictorial view of a heat shrinkable plastic tube which can be formed into a bag by appropriate heat shrinking.
Figure 11:
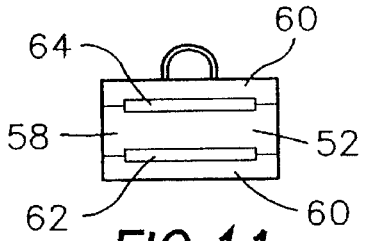
FIG. 11 is a view in elevation showing the bag formable tubular shrink wrap formed about the luggage.
Figure 12:
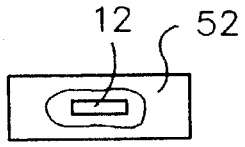
FIG. 12 is a top plan view of the wrapped luggage of FIG. 11.
Figure 14:
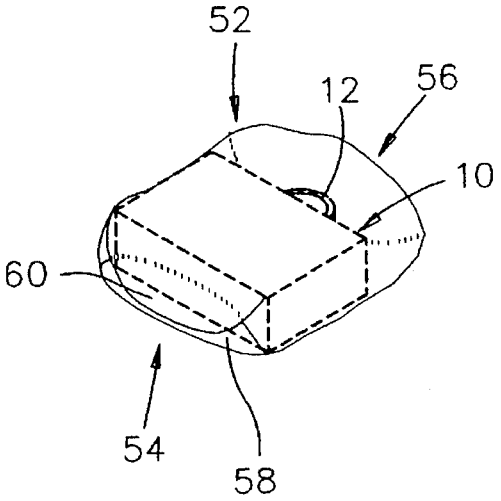
FIG. 14 is a pictorial view of the luggage showing the tuck and fold of the tube on the bottom of the luggage.
Figure 13:
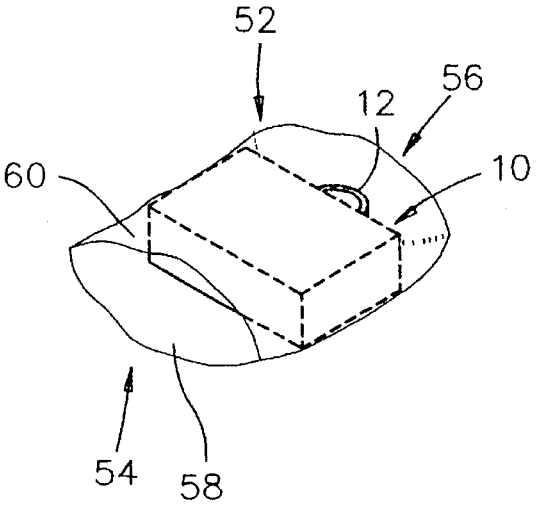
FIG. 13 is a pictorial view showing the luggage inside the open ended tube.

Also, as shown in FIG. 10, 11 and 12, a tubular plastic bag 52 may be used. Such a bag may be employed as a flat shrink wrappable tube, dispensable in continuous web form from a roller as in FIG. 2 and cut to size to provide the proper width W. The bottom 54 is sealed in the fitting and heat shrinking method while the open top 56 of the bag is fitted around the top of the luggage and slit to provide a slot to leave the grip exposed. The fabrication is described below.

EXAMPLE 2

The user takes the width, length, height and adds the height to each of width and length. This will give you the size bag you will need when formed around the luggage.

EXAMPLE: 25 Lx 20 Wx 7H=32 Lx 27 W

Now sufficient length is added to the shrink material for both ends of bag such as bag 52. Enough material is added for both ends of the bag to wrap over to the side of the bag.

As an example, ½ of height is 3½ inches so add this number to the width and 6 inches to wrap the edge to the side of the bag. This is sufficient for one end and the same must be added for the other end. In this example there would be added to the 27 inches width of the bag 19 inches for the wrap and now the adjusted width of the shrink material is 46 inches. Now the material can be cut to this width so the luggage will fit in with enough material to wrap each end. To hold the material to the side of the bag the Super Bond tape is employed. The tape is to hold the wrapped end of the material to the side of the bag and the enclosed luggage.

TUCK AND WRAP OF BAG

One bottom side 58 of the shrink material (bottom 54) is tucked inside of the opposite side 60 of the shrink material. The opposite side 60 of the shrink material is then wrapped over the bottom of the bag and then taped by tape 62 to the side of the bag. This "tuck and wrap" provides extra material on the bottom in the form of two plies or a double thickness for extra protection of the bottom. This is quite advantageous since the bottom takes most of the wear as the luggage is supported on the bottom in transit.

This "tuck and wrap" at both ends of the bag provides extra coverage to secure the luggage.

The top of the luggage 10 has a handle grip 12 and the handle has to be outside of the shrink material. This is effected by a similar "tuck and wrap" procedure as previously described with the addition of cutting slits or slots for the handle grip. Side 58 at the open top is folded or wrapped over the luggage and tucked inside of side 60 and a slot is cut for the handle. Then the other side 60 is wrapped over the handle grip 12 and a slot is cut for the handle grip. Side 60 is taped to side 58 by tape 64. The heat shrink operation is then carried out as previously described to encapsulate the luggage while leaving the handle grip 12 free.

This "tuck and wrap" procedure will also work in the bag 14 of FIG. 3 with sealed and perforated edges. Sufficient inches are added to the length of the material to tuck and cut a slot for the handle grip and wrap over to the opposite side of the bag. Then a slot in the opposite sides for the handle and the opposite side is wrapped over the handle and taped followed by the heat shrinking as aforesaid.

In carrying out the heat shrink operation if the material is light weight, (1 Mil) or (2 Mil) the user could use a hair dryer to shrink the material to the luggage. If there is used 3 or 4 Mil shrink material the greater heat required may be provided by a hot air gun. The hot air gun will give a higher temperature to shrink the material. By moving, hair dryer or hot air gun, back and forth and up and down over the material it will shrink to the luggage. The luggage is turned over on its side to shrink the bottom. The hair dryer may be used close to the material. The hot air gun should be used at a safe distance such as 12 inches to 16 inches. The use of the hot air gun will not then melt and form undesired holes in the material.

Various changes and modifications may be made within this invention as will be apparent to those skilled in the art. Such changes and modifications are within the scope and teaching of this invention as defined in the claims appended hereto.

What is claimed is:

1. A method for encapsulating luggage having a handle grip with a heat shrinkable plastic wrap to provide protection for the surface of the luggage and to provide visual detection of entry into the luggage, said method comprising: providing a plurality of heat shrinkable plastic bags in the form of preformed flattened tubes open at both ends, selecting an appropriate sized tube and cutting said tube to an appropriate sized length, as necessary to fit the luggage being wrapped, loosely enclosing the luggage in said cut tube so that the tube fits around the luggage with an open bottom end and opposite top end of tube extending beyond the top of the luggage and the grip, sealing the bottom end of the tube by tucking a first bottom side inside a second opposite side and wrapping the second opposite side over said first side to form a bag having an open top, and sealing the top portions of the open top over the grip and top of the luggage by heat applied by a hot air gun.

2. The method of claim 1 in which the tube is selected of a size determined by measuring the length, width and height of the luggage in inches, adding about one inch to the height to provide a sum, said sum being added to each of the length and width to determine the length and width of the tube.

3. The method of claim 1 in which the bag is formed as one of a plurality of bags separated as tear-off bags in a web mounted as a roll upon a roller.

4. The method of claim 1 in which the plastic tube is wound in a flat integral two sided web from a roll upon a roller.

5. The method of claim 1 in which a top end of the tube is sealed over the top of the luggage by tucking a first top side inside a second opposite side, cutting a slit to fit the grip therein, wrapping the second opposite side over said first side and cutting a slit to fit the grip therein.

6. The method of claim 5 in which the bag in the form of the tube is selected of a size determined by measuring the length, width and height of the luggage in inches, adding the height to each of the length and width and adding sufficient inches of material to the width to tuck and wrap the sides at the bottom and top of the luggage.

* * * * *